United States Patent [19]

Owens

[11] 4,278,856

[45] Jul. 14, 1981

[54] FLUID PRESSURE INDICATOR SWITCH APPARATUS

[76] Inventor: Charles A. Owens, 6616 Dixie Dr., Houston, Tex. 77087

[21] Appl. No.: 53,266

[22] Filed: Jun. 29, 1979

[51] Int. Cl.[3] ..... H01H 35/38

[52] U.S. Cl. ..... 200/82 R; 200/308; 116/272; 73/744

[58] Field of Search ..... 116/272, 273, 266, 276; 73/744, 745, 239, 240; 335/305; 340/626, 686; 200/82 R, 82 B, 82 C, 308, 56 R, 81.9 R

[56] References Cited

U.S. PATENT DOCUMENTS

| | | | |
|---|---|---|---|
| 3,040,896 | 6/1962 | Stem | 335/305 |
| 3,910,120 | 10/1975 | Martin | 73/744 |
| 3,937,912 | 2/1976 | Martin | 200/82 C |
| 4,163,970 | 8/1979 | Allinquant | 200/61.62 |

*Primary Examiner*—Gerald P. Tolin
*Attorney, Agent, or Firm*—Pravel, Cambrell, Hewitt, Kirk, Kimball and Dodge

[57] ABSTRACT

An apparatus for use with pressurized fluid supply lines which will electrically shut down a fluid pump and the machinery to which the fluid is furnished whenever a predetermined pressure drop occurs in a fluid supply line from the pump. The apparatus provides a visible indication when it is actuated by the predetermined pressure drop, so that when a series of the apparatus is used in an installation, for a plurality of lubricators or the like, the operator can readily determine which apparatus of the series was actuated by the pressure drop. Additionally, this apparatus has means for attracting and holding foreign magnetic particles in the pressurized fluid flowing through the apparatus.

5 Claims, 3 Drawing Figures

FLUID PRESSURE INDICATOR SWITCH APPARATUS

TECHNICAL FIELD OF THE INVENTION

The present invention relates to a switch apparatus designed for pressurized fluid supply lines which will electrically shut down machinery and the supply of the pressurized fluid whenever a predetermined pressure drop occurs in the fluid supply line to the apparatus. More particularly, the invention offers a highly visible indication of the position of the switch, along with a means located inside the switch for attracting and capturing metallic impurities from the pressurized fluid in the fluid supply line. The invention is particularly useful when employed with a series of lubricating oil lines for machinery which are supplied from a common supply line. When the supply line is shut down due to a pressure drop at any of the switch apparatus in the series, the operator can visually locate which one of the switch apparatus caused the shut-down.

PRIOR ART

Various switches have been designed in the past to protect machinery from the interruption of its supply of lubricating oil. The typical switch in the prior art causes the machinery to cease operation whenever there is a predetermined pressure drop in a fluid supply line. But the lack of a highly visible indication of the position of each switch when many switches are employed in series to monitor the supply of lubricating oil to machinery from a common pump or other pressurized fluid supply line necessitates the examination of each switch in the series to determine which switch and which fluid line needs attention.

Similar switches to this invention, designed by the present inventor with transparent caps, have been previously employed in the field. These switches, however, suffered from severe leakage problems in the central cavity. Additionally, they could not be employed with fluid lines containing high pressure fluids. Even at pressures under 70.3 kilograms per square centimeter, much less 351.5 kilograms per square centimeter, the above-mentioned switches frequently failed, blowing their caps off.

Additionally, metallic impurities in fluid supply lines, particularly impurities in oil lubrication lines, cause serious problems in large machinery.

SUMMARY OF THE INVENTION

The present invention is employed to monitor the supply of pressurized fluid in fluid supply lines and to shut down machinery and the fluid supply if the pressure in the fluid supply lines drops to a predetermined level. Normally, the pressurized fluid will be lubricating oil. The instant switch provides a visible indication of the position of the switch, enabling the machine operator to instantly locate which fluid line out of a series of fluid lines needs repair. The invention is also useful in monitoring isolated, frequently untended machinery in the field.

The apparatus has a housing, an enclosed piston with an elongated stem which is held in position by a retaining insert, a transparent cap, and an electrical contact. A retaining insert is utilized to close one end of a central cavity in the housing and to prevent the piston from leaving the central cavity, even under very high pressures of 351.5 kilograms per square centimeter. In addition, the retaining insert has a central guide bore for receiving and guiding the longitudinal movement of a greatly elongated piston stem. This stabilization of the piston movement provided by the retaining insert and the elongated stem eliminates leakage problems around the piston head. Pressurized fluid maintains the piston out of engagement with the electrical contact as long as the pressure of the fluid stays above a certain predetermined pressure.

The elongated stem of the piston is visible through a transparent portion of the cap. In the preferred embodiment, the entire cap is transparent and disposed at the top of the housing. When the pressure of the fluid drops below that predetermined level, a spring forces the piston into an electrical connection with the electrical contact and causes a short-circuit or overload to open or de-activate the electrical circuit. This stops operation of the machinery and the fluid pump or supply, thereby averting a possible disaster. In addition, the insulated electrical contact is located for electromagnetically attracting and capturing metallic particles in the pressurized fluid which might otherwise damage the machinery being lubricated.

DETAILED DESCRIPTION

The fluid pressure indicator switch is designed to monitor pressurized fluid supply lines and will electrically shut down machinery and the fluid supply whenever a predetermined pressure drop occurs in a fluid supply line. The switch provides a visible indication of the position of the switch and additionally attracts and captures metallic impurities from the pressurized fluid in the fluid supply line.

The switch is capable of monitoring pressurized fluids at pressures from zero to 351.5 kilograms per square centimeter. The design of the switch emphasizes a metallic retaining insert, which also serves as a guide for the movement of a piston with an elongated stem, enables the switch to monitor high-pressure lubricating lines on compressors and engines without leakage. But the fluid pressure indicator switch may also be used on other fluid supply lines besides lubricating oil. The switch works equally well with other liquids and gaseous fluids with suitable changes in the design parameters of the compression spring required.

Figure 1:
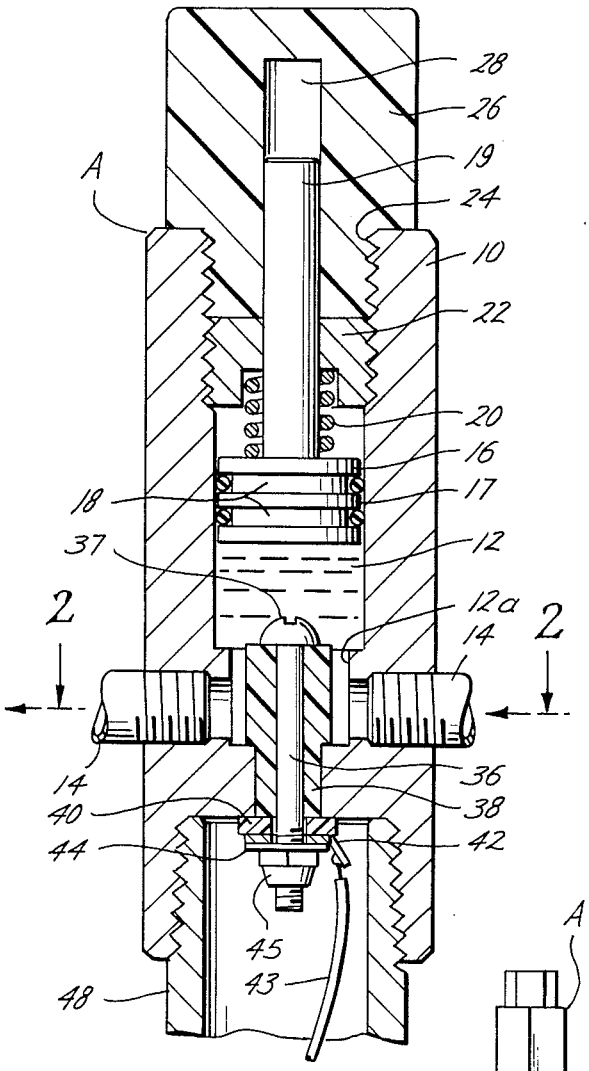
FIG. 1 is a vertical cross-sectional view of the switch.

FIG. 1 illustrates the housing 10 of the switch A, which contains a central cavity 12 and two means of communication, threaded holes 14, between the central cavity 12 and the exterior of the switch. The threaded holes 14 provide means of ingress and egress to and from the central cavity 12 for the pressurized fluid of the fluid supply lines.

In the preferred embodiment, the housing 10 is a hexagonal piece of electrically conducting metal, more preferably aluminum or stainless steel. It is designed to encase all the elements of the switch and serves as part of the electrical circuit of the switch. However, the housing 10 can be manufactured out of a non-electrically conducting material, without going beyond the breadth of the present invention, as long as an alternate means of completing the electrical circuit is provided.

The housing 10 serves as a cylinder for the piston 16, which is composed of a piston head 17 and an elongated stem 19. The stem 19 is designed with sufficient length so as to provide a highly visible indication of the position of the switch by observance of the stem 19 in the transparent cap 26. The piston 16 is manufactured out of an electrically conducting metal, preferably stainless steel. The piston head 17 is sealed by two O-rings 18 which are placed in two recessed seats in the piston head 17. The O-rings are of standard butyl type, well known in the art, in the preferred embodiment. However, special composition O-rings can be substituted.

A resilient means for counteracting the force of the pressurized fluid of the fluid supply line in the central cavity 12 is provided by a compression spring 20, which urges the piston towards the electrical contact 36. The spring 20 is a stainless steel, compression spring in the preferred embodiment. It is placed over the stem of the plunger and is held in place by the retaining insert 22 which is screwed into the housing 10 on threads 24. The spring 20 is designed with compression properties such that the spring 20 will begin compression at approximately 1.4 kilograms per square centimeter of fluid pressure and be fully compressed at approximately 4.2 kilograms per square centimeter of fluid pressure in the central cavity 12. Of course, the compression spring 20 can be manufactured for different compression properties so as to change the operation of the switch under different fluid pressures.

The retaining insert 22 is a threaded piece of metallic stock which serves several purposes. First, it serves as a guide for the elongated stem 19 of the piston 16. The combination of the retaining insert 22 and the elongated stem 19 stabilizes the position and movement of the piston 16 so that leakage from the central cavity around the piston head 17 is held to a minimum. Second, it provides a recessed cavity for the positioning of the compression spring 20. Third, the retaining insert 22 and threads 24 of the housing 10 are designed with ample strength so as to retain the piston 16 and give the switch its high-pressure capabilities. The use of such a retaining insert is necessary if a transparent cap 26 is employed since a transparent cap 26, alone, is not strong enough to withstand the force of highly pressurized fluids.

The cap 26 is located on top of the housing 10 and sits in recessed threads 24 on top of the retaining insert 22. In the preferred embodiment, the cap 26 is a cylindrical piece of plexiglass or other transparent material. The cap 26 contains a channel 28 which serves as a guide for the elongated stem 19 of the piston 16 as well as a visual indicator of the position of the elongated stem 19. At least a portion of the cap 26 is transparent to allow for the visual observation of the elongated stem 19 as it moves longitudinally when the fluid pressure drops and the piston 16 engages the electrical contact 36.

An electrical contact 36, which may be a standard bolt with a slot 37 in its head, is positioned within the central cavity 12 of the housing 10. The electrical contact bolt 36 is well insulated from the housing 10 by the use of an insulator 38 which surrounds the shaft of the electrical contact bolt 36, and an insulator washer 40 which is positioned so as to securely hold the electrical contact bolt 36 and insulator 38 in position with the aid of a metal washer 44 and a lock nut 45.

An electrical connector 42 is placed between the insulator washer 40 and the metal washer 44. The electrical connector 42 is attached to a live wire 43 which leads to a relay box. The insulators can be made of any material which does not conduct electricity. In the preferred embodiment, nylon, which is a superb insulator, is utilized. The housing 10 of the switch is grounded through the conduit 48 upon which the switch is mounted.

In addition to monitoring the pressure of the fluid in the fluid supply line and providing a highly visible indication of the position of the switch, the present invention cleanses magnetic foreign particles from the pressurized fluid of the fluid supply line. The holes 14, provided for the flow of the pressurized fluid into and out of the central cavity 12, are positioned in close proximity to the electrical contact bolt 36. The bolt 36 extends into a lower annular recess 12*a* forming part of the cavity 12 and surrounding the bolt 36. Such construction forces the pressurized fluid into close proximity with the electrical contact bolt 36. The contact bolt 36 functions as an electromagnet and attracts and captures small metallic particles in the pressurized fluid. This feature becomes particularly advantageous when the pressurized fluid is lubricating oil, since it prevents metal particles from reaching the moving parts of the compressor or equipment being lubricated. Thus, the switch additionally performs the function of cleansing the pressurized fluid of metallic particles.

The switch is sealed from all weather conditions and can be made explosion-proof by adding conduit protection at the bottom of the switch. FIG. 1 illustrates a conduit 48 upon which the switch can be mounted by means of threads 46 in the housing 10.

Figure 2:
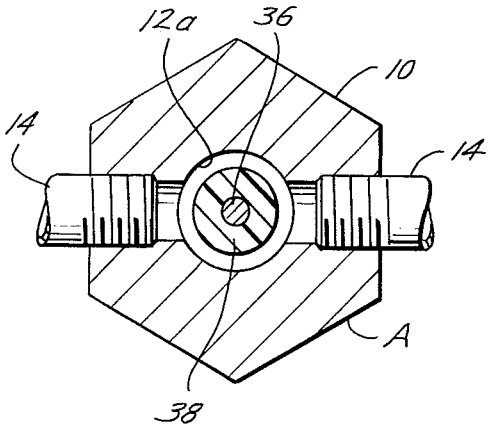
FIG. 2 is a horizontal cross-sectional view of the switch taken along the line 2—2 in FIG. 1.

FIG. 2 illustrates a horizontal, cross-sectional view of the switch along the lines 2—2 in FIG. 1. The threaded holes 14 which provide communication to the central cavity 12 are clearly shown. Concentric rings in the center of FIG. 2 indicate the proportional sizing of the different parts of the switch contained in the central cavity 12. The slot 37 at the top of the electrical contact bolt 36 is clearly shown along with the insulator 38.

Figure 3:
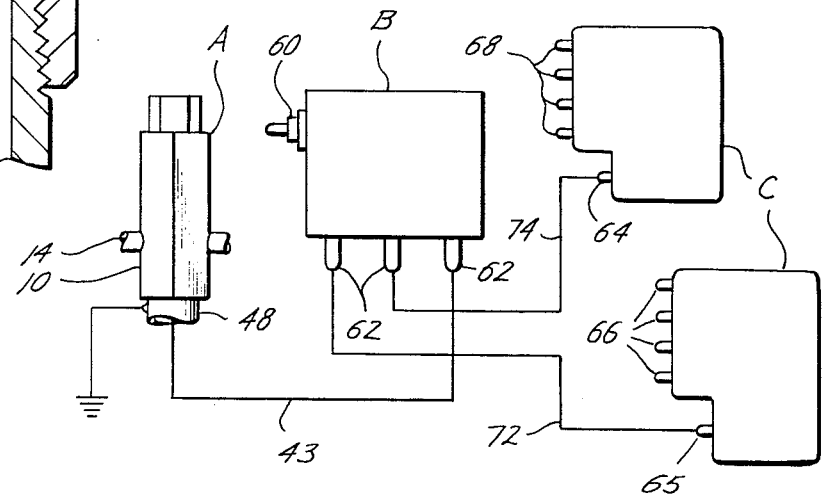
FIG. 3 is an electrical diagram illustrating the connection of the switch with an ignition system for machinery.

FIG. 3 is a diagram illustrating the electrical connection of the switch A with an ignition system for machinery. The housing 10 is grounded by the mounting of the switch A upon the conduit 48. A relay box B with a central switch 60 is positioned between the switch A and the dual magnetos C of the ignition system.

The switch A is connected to one of the three terminals 62 of the relay box B by means of a live wire 43. The relay box B is electrically connected to each of the magnetos C by wires 72 and 74 connected to terminals 62 of the relay box B and terminals 64 and 65 of the magnetos C. Terminals 67 and 68 of the magnetos C provide ignition to the relevant machinery, i.e., the engine and fluid pumps.

OPERATION OF THE SWITCH

Pressurized fluid from the fluid supply line enters the housing 10 by means of one of the holes 14 and passes into the central cavity 12. The pressurized fluid is forced to flow around and over the electrical contact bolt 36 and insulator 38. The electromagnetic effect of the electrical contact bolt 36 captures magnetic metallic particles from the pressurized fluid. The pressurized fluid expands the central cavity 12, forcing the piston 16 to move in the housing and compressing the spring 20.

In the preferred embodiment, the compression spring 20 is designed so that compression will begin when the pressure of the fluid reaches about 1.4 kilograms per square centimeter. Compression of the spring 20 will occur proportionately as pressure rises until the pressure is equal to about 4.2 kilograms per square centimeter. At this point, the spring 20 will be fully compressed, and the piston head 17 and elongated stem 19 of the piston 16 will be at their highest point of upward travel. The elongated stem 19 of piston 16 will be highly visible in the channel 28 of the transparent cap 26.

The switch accommodates pressures of up to 351.5 kilograms per square centimeter. Normally, the pressurized fluid passing through the switch will be of a very high pressure. Consequently, the spring 20 will usually be fully compressed, and the elongated stem 19 will be in the extreme upward position. However, when pressure of the pressurized fluid drops below 4.2 kilograms per square centimeter, the compression spring 20 will urge the piston 16 towards the electrical contact bolt 36 and shrink the size of the central cavity 12. This will be visible to the operator since the elongated stem 19 will start falling in the channel 28 of the transparent cap 26.

When the fluid pressure has decreased to 1.4 kilograms per square centimeter or below, the elongated stem 19 will have entirely disappeared from the channel 28, and the piston head 17 will be in electrical connection with the electrical contact bolt 36. This action will ground the live wire 43, causing a direct short. Consequently, the relay box B will cut ignition power to the machinery and fluid pumps through its electrical control of the magnetos C.

Because of the above-explained scope of the invention, many varying and different embodiments may be made by those skilled in the art without departing from the breadth of the inventive concept herein taught or the claims appended hereto. Thus, it should be recognized that the instant invention can be made by the employment of different materials of construction or the use of a different design, without deviating from the scope of protection of this invention.

I claim:

1. A switch designed for pressurized fluid supply lines which visually indicates the position of the switch, comprising:

a housing with a central cavity;

an electrically conductive piston disposed within the central cavity of the housing having an elongated stem;

a retaining insert mounted at one end of the housing to close said one end, said insert having a guide bore receiving the elongated stem of the piston;

a cap mounted at one end of the housing adjacent to the retaining insert, said cap containing a channel receiving the elongated stem of the piston;

an electrical contact in the opposite end of the housing from the cap;

resilient means for moving the piston towards the electrical contact when the pressure of the fluid in the central cavity drops below a predetermined amount;

said housing having an annular recess forming a part of said central cavity and surrounding a portion of said electrical contact for forming a pocket;

said housing having holes which provide for fluid communication through the annular recess; and said cap having a portion thereof which is transparent for the visual observation of the elongated stem as it moves longitudinally for the engagement of the piston with the electrical contact when the fluid pressure in the central cavity drops below the predetermined amount.

2. The apparatus of claim 1, wherein the resilient means is a compression spring disposed around the elongated stem of the piston.

3. The apparatus of claim 2, wherein the compression spring urges the piston into engagement with the electrical contact when the pressure of the fluid in the central cavity drops below about 1.4 kilograms per square centimeter.

4. The apparatus of claim 1, wherein the electrical contact is an electrically conducting bolt mounted to the housing, but insulated from the housing, said electrical contact being connected to an electrical circuit which is interrupted when the piston engages the electrical contact.

5. The apparatus of claim 1, wherein the cap is releasably mounted in the top of the housing.

* * * * *